US005887287A

United States Patent [19]

Potochnik

[11] Patent Number: 5,887,287

[45] Date of Patent: Mar. 30, 1999

[54] HEADWEAR WITH POCKET(S) AND A PLURALITY OF ATTACHMENTS

[76] Inventor: Robert J Potochnik, P.O. Box 4497, Boca Raton, Fla. 33429

[21] Appl. No.: 729,769

[22] Filed: Oct. 7, 1996

[51] Int. Cl.[6] ..... A42B 1/24

[52] U.S. Cl. ..... 2/209.13; 2/172; 2/247

[58] Field of Search ..... 2/172, 209.13, 2/195.1, 247

[56] References Cited

U.S. PATENT DOCUMENTS

| | | | |
|---|---|---|---|
| D. 160,404 | 10/1950 | Levine . | |
| 899,334 | 9/1908 | Seitzman . | |
| 1,161,637 | 11/1915 | Dunn . | |
| 1,869,652 | 8/1932 | Baker . | |
| 2,349,471 | 5/1944 | Starbeck . | |
| 2,615,168 | 1/1952 | Tannenbaum . | |
| 2,704,366 | 3/1955 | Arnold . | |
| 2,744,256 | 5/1956 | Slotkin . | |
| 3,505,682 | 4/1970 | Mims . | |
| 4,165,542 | 8/1979 | McLaughlin . | |
| 4,179,753 | 12/1979 | Aronberg et al. | 2/209.13 |
| 4,312,076 | 1/1982 | Gamm | 2/209.13 |
| 4,386,437 | 6/1983 | Fosher | 2/209.13 |
| 4,472,837 | 9/1984 | Saxton . | |
| 4,484,363 | 11/1984 | Varanese | 2/209.13 |
| 4,630,317 | 12/1986 | Brown . | |
| 5,046,195 | 9/1991 | Koritan | 2/172 |
| 5,048,128 | 9/1991 | Watson, Jr. . | |
| 5,062,157 | 11/1991 | Muta . | |
| 5,099,524 | 3/1992 | Linday . | |
| 5,121,507 | 6/1992 | Brown | 2/172 |
| 5,136,726 | 8/1992 | Kellin . | |
| 5,201,077 | 4/1993 | Dondlinger | 2/172 |
| 5,373,586 | 12/1994 | Brosnan | 2/195.1 |
| 5,454,120 | 10/1995 | Rowlands | 2/195.1 |
| 5,669,075 | 9/1997 | Weeks | 2/172 |
| 5,704,070 | 1/1998 | Stogner | 2/209.13 |

FOREIGN PATENT DOCUMENTS

| | | | |
|---|---|---|---|
| 579322 | 7/1958 | Italy | 2/209.13 |

*Primary Examiner*—Diana L. Biefeld

*Attorney, Agent, or Firm*—Malin, Haley, DiMaggio & Crosby, P.A.

[57] ABSTRACT

A headwear (16) designed with a permanent or removable pocket that holds objects about the crown (17). A Veil (21) attaching to the crown (17) hanging about the back and side portion of the person. An outside grasping member (23) attaches to the headwear (16) for storing objects on the outside. The pocket is formed of a pair of liners, using a inner liner comprising a segment of the crown (17) and an additional outer liner (30) stitched (29) proximate its top edges with the bottom portion being secured with a fastener or a separate set of liners stitched proximate their top edges with the bottom portion secured with a fastener making it removable from the headwear (16). A veil (21) made with sufficient material that encompasses the headwear (16) from side to side and in length to protect the wearer's upper body. A veil (21) with optional fasteners 27 and handle device 36 connected to the veil thereby utilizing it as a carrying entity. An outside grasping member (23) made of two pieces of fastening products attached to the outside of the headwear (16) when separated and resealed hold objects securely.

10 Claims, 8 Drawing Sheets

HEADWEAR WITH POCKET(S) AND A PLURALITY OF ATTACHMENTS

BACKGROUND OF THE INVENTION

1. Field of the Invention

This invention relates to headwear, in particular headwear having an interior pocket that is permanent or removable, a veil, and an outside grasping member.

2. Description of Prior Art

Many styles and forms of headwear have been patented and used for various activities, some with a single secondary function, but these had and can still have significant problems that limit their usefulness. An example of a headwear that serves a secondary function is illustrated in U.S. Pat. No. 4,312,076 Gamm. This invention had a pocket in the front of the headwear thus making it small, and not removable.

Another example is in U.S. Pat. No. 4,386,437 Fosher, this invention has a pocket area between the bottom crown portion with an insert placed inside the crown, making it bulky, ridged, and limited the pocket area.

In addition U.S. Pat. No. 4,472,837 Saxton, this invention has a pocket and separate pocket insert that secures items on a plate like platform. This design made the headwear non flexible, large, and weighty having only a specific market audience.

Further in U.S. Pat. No. 2,744,256 Slotkin, this invention had multiple pockets but involved a rigid headwear design and was weighty.

Finally in U.S. Pat. No. 5,048,128 Watson, Jr. this invention incorporates a headcovering and a veil in one. This invention has no detachable veil, pockets, or attachments on the headcovering itself.

All of the above inventions serve in one manner or another, and use the headwear for a single function of either storing or protecting. Each apply all the advantages as listed below,

SUMMARY OF THE INVENTION

My headwear relates to improvements in the headwear for men, women, children, and infants designed for versatile use in all seasons and climates. My protective, novel headwear, provides covering or shading for one's head, eyes, ears, neck, and upper shoulders. The headwear provides a secure area for objects either permanently attached or detachable through a pocket(s) on the headwear. The detachable pocket can act wallet, carrying pouch, or collector's item.

My headwear provides a way of attaching objects such as glasses or other objects to the outer portion of the headwear. The person can remove perspiration or grime with an absorbent removable veil or the veil can be utilized as a holding device and/or carrying entity. The veil can accommodate ornamentation. The person can utilize the veil as a pocket or holding device either attached to the headwear or removed. Advertising insignia for example; logos, Snap-On's, Wash-offs, will accommodate the veil likewise.

My headwear can be a novelty for a person through variation in: ornaments, colors, logos, removable pockets, veils, and enclosures. My headwear has a novelty component through varying ornamentation on the pockets, veils, and enclosures. A specific groups' insignia placed upon each element provides a similar but different headwear thereby increases its ability to be a collector's item.

Accordingly, among the several objects of this invention can be noted a provision of headwear, having an exterior covered pocket or pockets that can be permanent or removable;

- a provision of such headwear with a pocket of sufficient size to hold keys, licenses, money, credit cards, gloves etc.;
- a provision of such headwear in which a pocket is permanent, and not distinctly visible;
- a provision that a pocket is removable as well as distinctly visible plus any combination thereof;
- a provision such that the pocket can be removed and replaced with another pocket of similar shape but with different ornamentation;
- a provision providing the use of a fastening device, in the form of a closure member or hook and loop material that can conveniently secure the pocket,
- a provision of a veil that can be used as a secondary entity for holding or storing objects while attached to the headwear or can be removed and utilized separately,
- a provision of a veil that can be removed or permanent and that ornamentation can be applied;
- a provision that the veil can be substituted for another veil of different size, shape;
- a provision that the veil be changed because of different ornamentation's to which that persons taste or advertisers specifications;
- a provision such that the veil can be made of an absorbent like material to wipe excess dirt, grim, or other elements from the person;
- a provision such that an outside grasping member located on the crown can hold objects when not in use;
- a provision where the grasping member can be removed and stored in the pocket.

These items provide a more comprehensive headwear insuring additional protection on the neck, shoulders, and upper torso; a covered and/or open storing pocket and/or holder, and a device holding bulky items on the outside. Additionally, when removed they can be placed within the headwear or substituted for other like but varying attachments. Further objects and advantages of my invention will become apparent from a consideration of the drawings and description.

REFERENCE NUMERALS IN DRAWINGS

Figure 1:
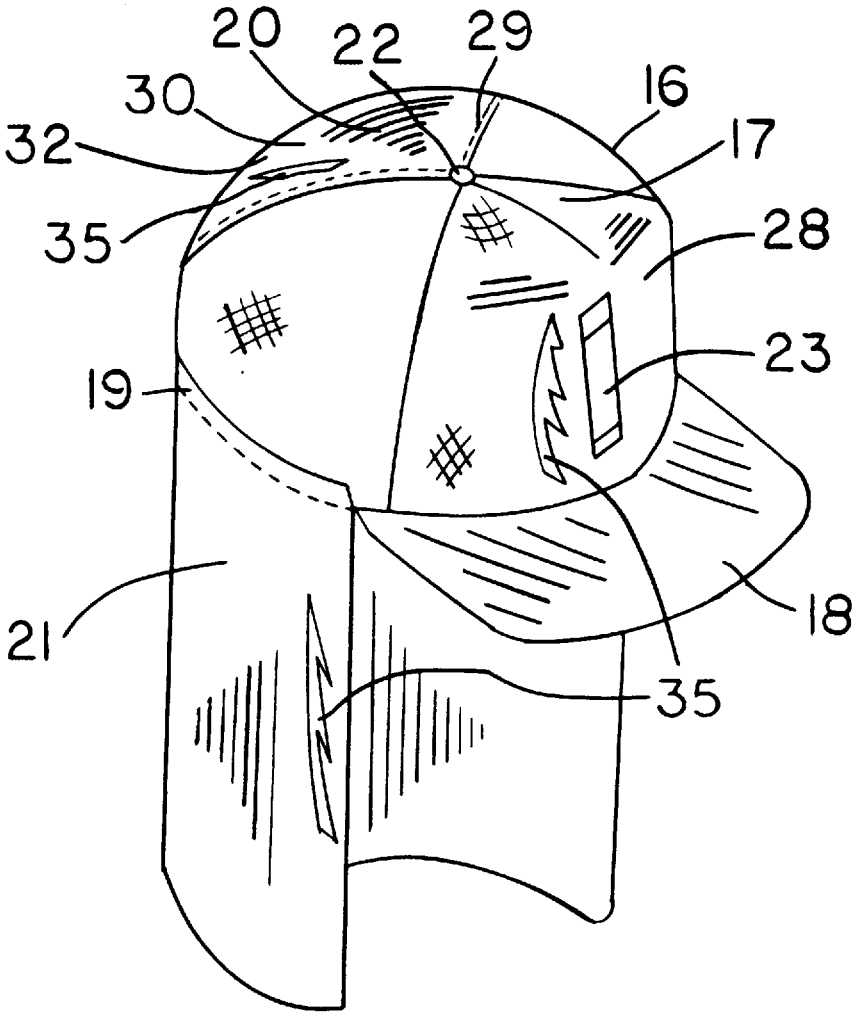
FIG. 1 discloses an isometric view of the formed headwear of this invention, disclosing the pocket along the back portion, the veil along the bottom portion, the outside grasping member along the front portion and ornamentation placed in various locations.

16. Headwear
17. Crown
18. Brim
19. Band
20. Back portion
21. Veil
22. Button
23. Outside grasping member
24. Grasping end
25. Hook fastener
26. Loop fastener
27. Optional fastener
28. Front portion
29. Stitching
30. Outer liner
31. Second outer liner
32. Pocket area
33. Attachment unit
34. Bottom portion of crown 17
35. Ornamentation
36. Handle device

DETAILED DESCRIPTION OF THE INVENTION

Referring to the drawings wherein like numerals refer to like and corresponding parts throughout several views, referring to FIG. 1 an isometric view of a headwear 16 which can be of varying design, and having a band 19 (see FIG. 2) that is sewn or attached by other devices to the crown. The crown can be formed with no band by a person skilled in the art that can fit appropriately to the users head dependent upon the materials used. The band 19 can be made of an adjustable device that adapts to varying head sizes or of fitted type to specifically accommodate the person's head by a person skilled in the art. A crown 17 is made of several separate pieces stitched 29 together or otherwise sealed at the edges to comprise the entire formed crown 17. A brim 18 extends from a front portion 28 of the headwear 16 sewn or attached by securing devices to the crown 17 or band 19. A hook fastener and a loop fastener secured to the outside bottom portion of the crown 17, and outer liner 30 is placed for the attachment of a veil 21.

A back portion 20 covered with an outer liner 30 of proportional shape is stitched 29, or otherwise secured from a button 22 downward to the bottom portion of the crown 17. Between the outer liner 30 and the crown 17 a pocket area 32 exists. A hook fastener 25 located on the bottom inside liner and a loop fastener 26 located on the bottom outside portion of the crown hold the pocket opening closed and secure objects within. The outer liner 30 can be folded open forming the entrance to the pocket area 32 storing items securely for the permanent pocket type design. Fasteners can be applied anywhere on the headwear 16 allowing a multitude of permanent pockets on one headwear 16. The liner can encompass one single area or the entire crown thereby forming a large pocket area.

An outside grasping member 23 is shown at its preferred location on the front portion 28 of the headwear 16. The grasping member 23 can be permanently stitched 29 or of a removable type through a snap or other temporary adhering devices. Ornamentation 35 can be attached with snaps, clips, hook and loop fasteners or other attachment units to the headwear 16. Ornamentation 35 such as but not inclusive to: logos, insignia, and inscriptions or any advertising material can be placed on the crown 17, brim 18, or veil 21.

The preferred embodiment of the crown 17 is of a cap like design such as a baseball cap but can be of a design such as a bicycle cap, cowboy hat, or fisherman's hat with an all encompassing brim 18, but not exclusive to the above mentioned styles. The crown 17, veil 21, outer liner 30, or second outer liner 31 can be made of a variety of materials including cotton, plastic, canvass, nylon, silk, liquid absorbent materials or any materials that give the desired amount of durability, rigidity, fashion or novelty for the wearer. The crown 17, brim 18, veil 21, outer liner 30, or second liner 31 can be utilized with the same color as the entire headwear 16 or of different or variable colors. The crown 17 can be large in size such as a cowboy hat or smaller such as a skull cap, or any variation in-between but not exclusive to the above mentioned.

Figure 2:
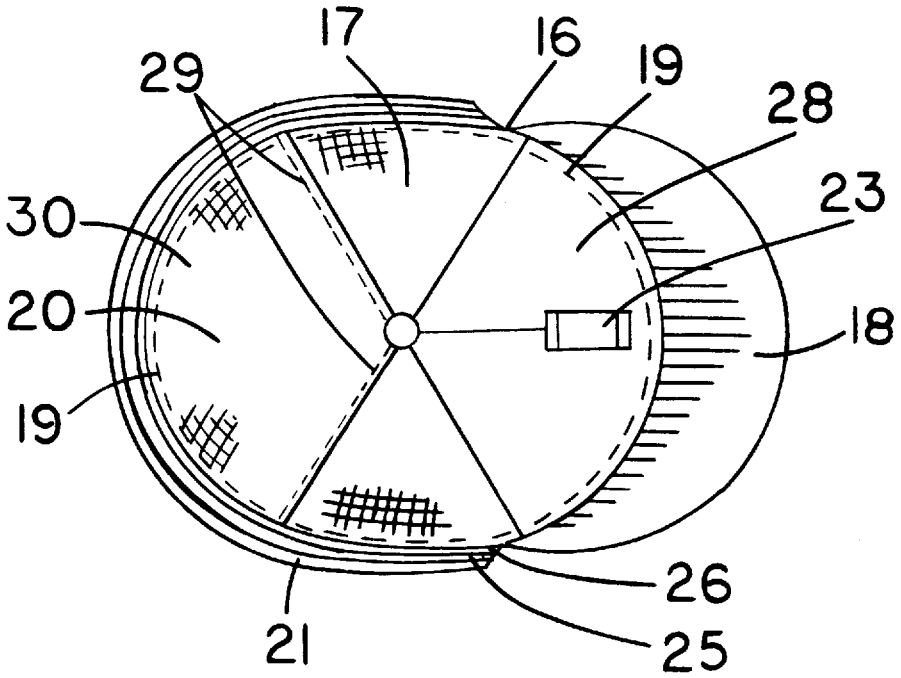
FIG. 2 discloses a plan view of the headwear disclosed in FIG. 1 showing the circumference of the veil, an additional view showing preferred pocket position and location of the enclosure piece.
Figure 5:
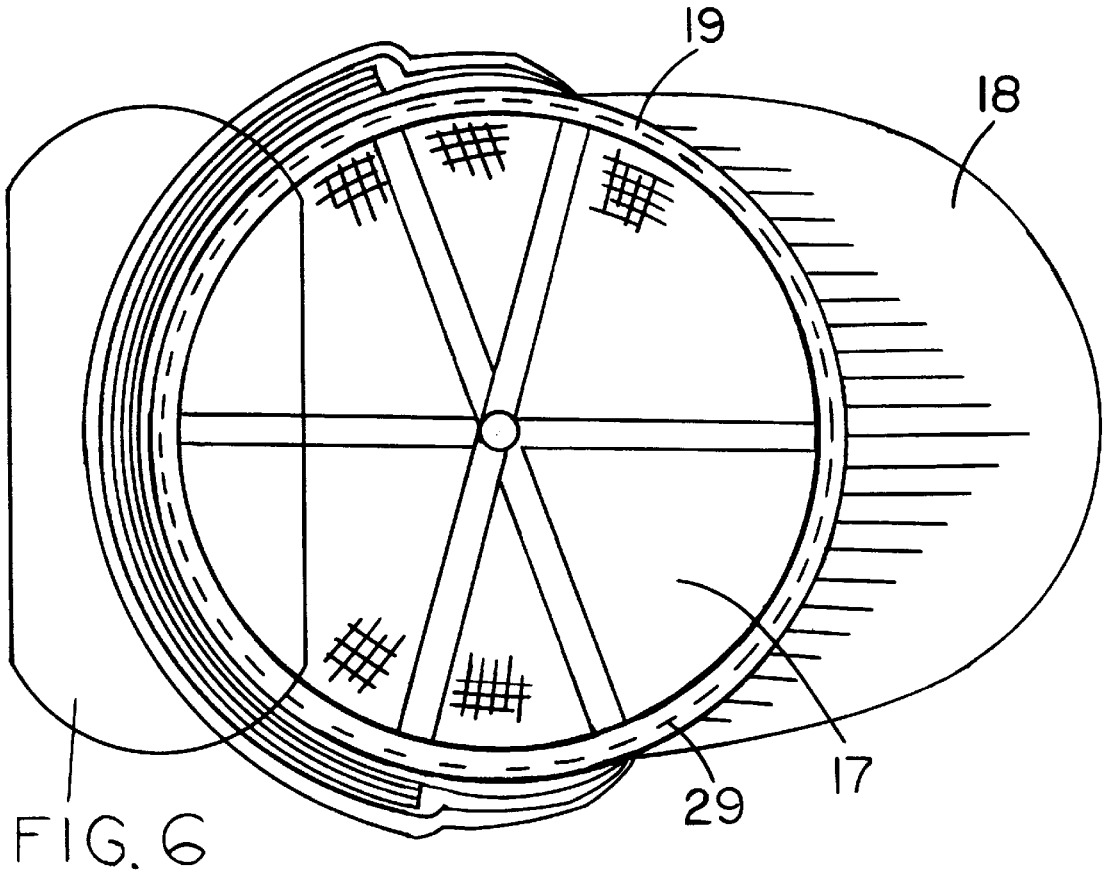
FIG. 5 discloses a bottom view of FIG. 2 disclosing the various layers of construction in the permanent pocket headwear and the preferred brim location.
Figure 6:
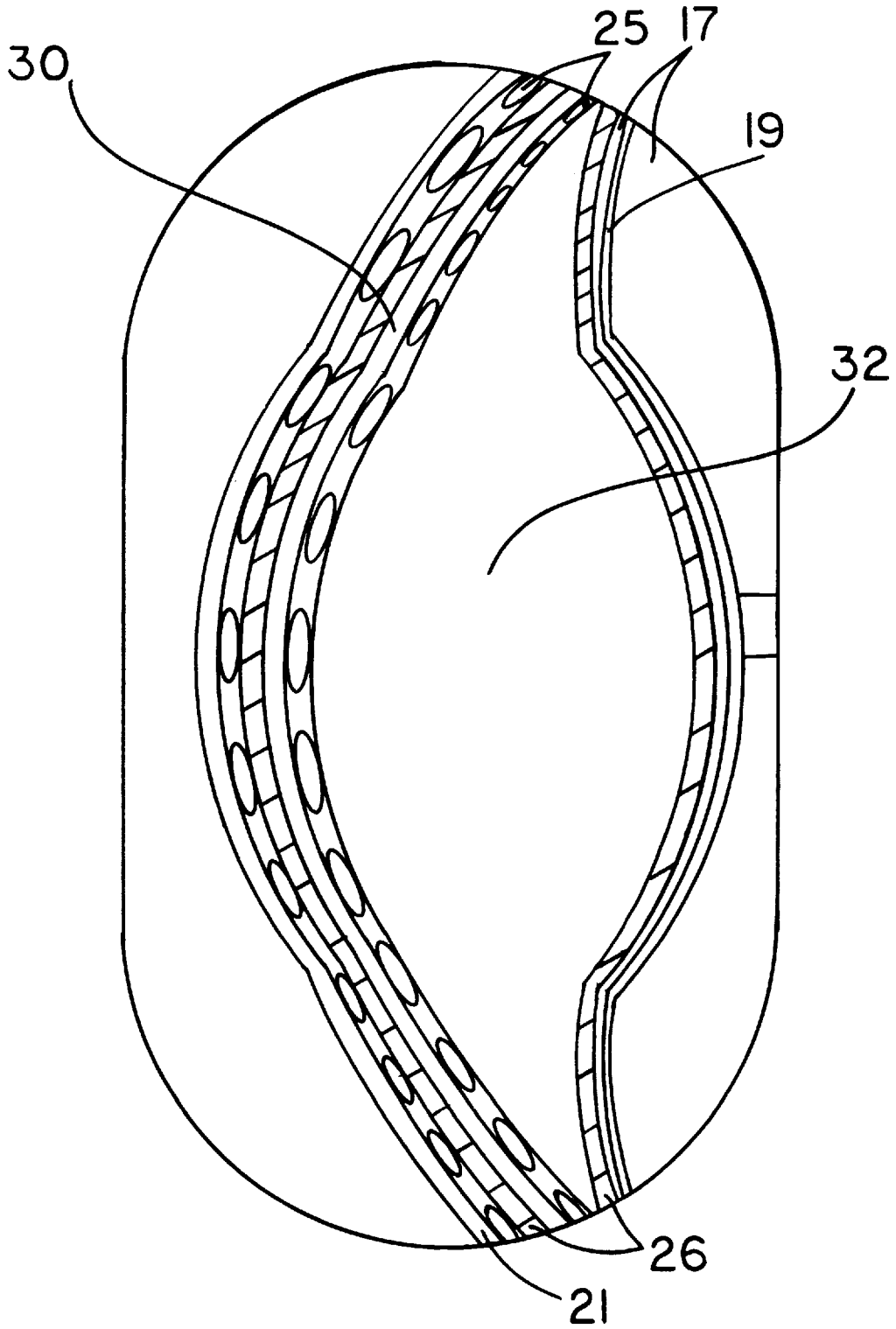
FIG. 6 discloses an exploded view of FIG. 5 disclosing the detailed layers of the permanent pocket headwear in the semi open position.

FIG. 2 is a plan view of FIG. 1 a headwear 16 including a band 19 sewn or otherwise secured around the circumference of the crown. The crown can be formed with no band dependent upon the materials used and still fit the users head. An outside grasping member 23 located in the center of a front portion 28. A loop fastener 26 secured by stitching 29 or other securing devices around the entire bottom outside portion of crown 34 (see FIG. 7) exclusive of secondary a brim 18 area. A hook fastener 25 and secured by stitching 29 or other securing devices to the entire top portion of a veil 21 thereby when placing the hook and the loop portions together securely fasten the veil to the bottom portion of the crown 17. An optional fastener 27 (see FIG. 7) can be sewn or otherwise secured about the veil itself. A handle device 36 can be added to the top, or side portion and secured by stitching 29 or other methods to the veil 21. An outer liner 30 secured to the crown 17 by stitching 29, attachment units or other securing devices to a back portion 20 for a permanent type pocket design. The outer liner The individual pocket layers are shown in FIG. 5 and FIG. 6.

The veil 21 shown at its preferred location is of rectangle shape but can be of varying shapes. The veil 21, outer liner 30 or second outer liners 31 shape can replicate the form of a logo, insignia, animal shape, or other embodiments for better utilization. The veil 21, outer liner 30 or second outer liners 31 size can duplicate various forms, or other embodiments for better acceptance. The veil 21 can have optional fasteners 27 (see FIG. 7) in the form of hook and loop fasteners or other devices located at the top or side, inside or outside of the veil 21 that can connect and secure together and form a pocket or holding area. The veil 21 can have a handle device 36 in the form of a strap or other devices that are removable or permanent (see FIG. 7). The veil 21 can be utilized as a carrying entity when combined with the handle device and/or optional fasteners. The veil can be placed in the pocket area 32 when not in use or removed altogether. The veil can be fashioned from absorbent materials or others such as cotton, wool, leather, plastic, or silk to provide the desired protection or from the elements but not exclusive to the above mentioned. The veil 21 can be utilized in a uniform color or of variable colors, such as camouflage for a specific desired purpose or for a general purpose.

The veil 21 can be removed to wipe dirt or grime from the person or replaced with a new one. The veil 21 can be used as an advertising device utilizing unique designs or styles.

The veil 21 can protect the person's head, eyes, ears, neck, and upper torso from the elements by its placement on the headwear 16. The veil 21 can be of compact nature with the ability to fit into the pocket area 32 of the headwear 16 when not in use. The veil 21 can be made of a liquid absorbent material providing the ability to dry objects such as a car, motorcycle, table, or even the person and then being able to rid itself of liquid and reused. The veil 21 can adopt different sizes or shapes and its material can be of variable type. The veil is not exclusive to the above mentioned and dependent upon the person, promoter or manufacturer.

Figure 3:
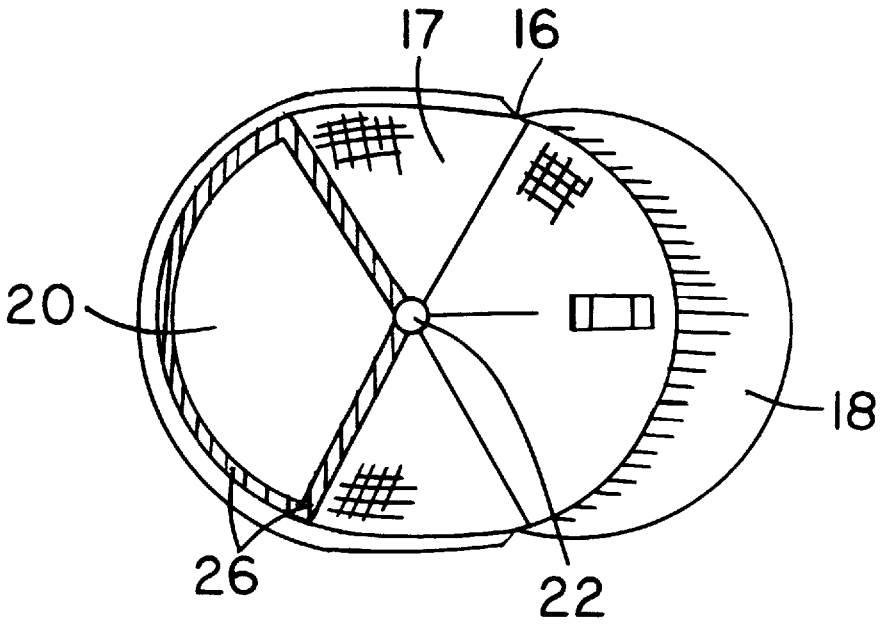
FIG. 3 discloses a plan view of the headwear disclosed in FIG. 1 showing the preferred location for the loop like material on a detachable pocket headwear.

FIG. 3 is a plan view of FIG. 1 a headwear 16 includes a crown 17 and a brim 18 with a loop fastener 26 secured by stitching 29 or other securing devices to a back portion 20 of the crown 17 in a triangle fashion. The fastening material attaches starting from a button 22 to a bottom portion of crown 34 (see FIG. 7) and across the bottom portion of the crowns edge meeting together to form an enclosed area. A outer liner 30 and a second outer liner 31 (see FIG. 3) are removed to show placement of the loop fastener 26. The loop fastener 26 placed in its preferred embodiment but can be attached only on one side, both sides, or in the front of the crown 17 or brim 18.

The hook or loop fasteners can be in placed in any order dependent upon the manufacturer, promoter, or person for better manufacturing or other reasons. Sporadically placing smaller fasteners in varied quantity creates an easier method of removing the liners and can reduce the cost of manufacturing. For a more versatile headwear the hook or loop fasteners can be removed and replaced with other securing devices.

Figure 4:
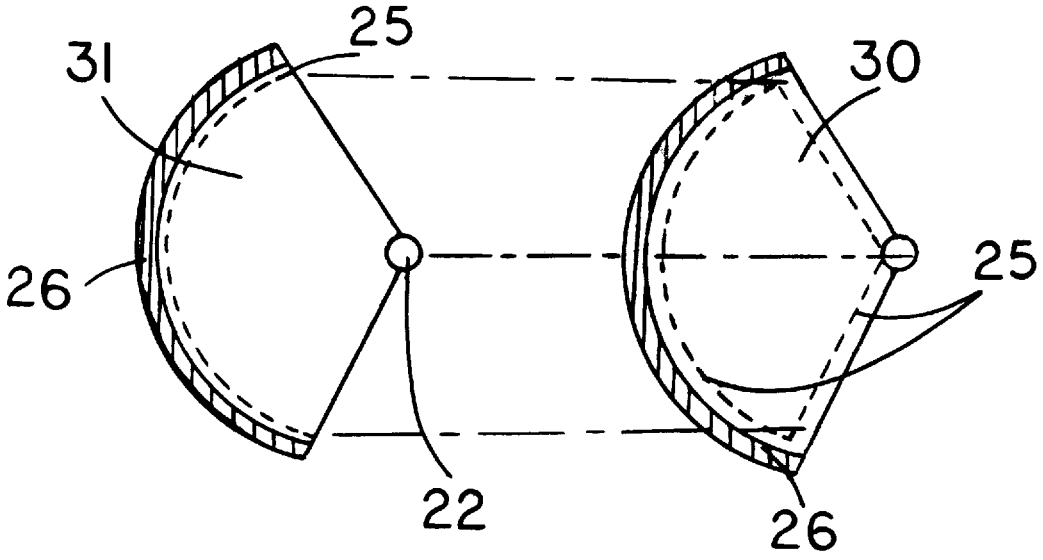
FIG. 4 discloses a partial plan view of FIG. 3 the outer liner and second outer liner showing the locations of the hook and loop like materials on the liners.

FIG. 4 is the partial plan view of FIG. 3 showing the removable pocket. An outer liner 30 and a second outer liner 31 secured by stitching 29, attachment units or other securing devices on the two sides that meet at a button 22. On the inside edges of the outer liner 30 a hook fastener 25 secured by stitching 29 or other securing devices is installed in an identical fashion as the crown 17 loop fastener 26. Joining the two fasteners together hold the liners to the crown temporarily. The outside bottom portion of outer liner 30 has the loop fastener 26 secured by stitching 29 or other securing devices and forms one part of the pocket opening. The inside bottom portion of the second liner 31 the hook fastener 25 secured by stitching 29, or other securing devices and forms the second part of the pocket opening. Joining the two fasteners together close the pocket opening temporarily and secure objects within. The outside bottom portion of the second outer liner 31 has the loop fastener 26 secured by stitching 29, or other securing devices and attaches to the hook fastener 25 of a veil 21 (see FIG. 6). The outer liner 30 and the second liner 31 act to secure objects for easy retrieval or when no pockets are available.

The liners can be separated from the crown and used apart or placed on other forms of headwear. The liners can be utilized as a wallet, carrying pouch or collectors' item. Ornamentation can be imprinted on the removable liner to create a collectors' liner that can be taken off and/or replaced with another. The liners can be removed and placed on another headwear if a person so chooses or different liners can be placed on the original headwear. Objects placed within the pocket can remain in the same pouch when changing headwear providing the person with a more versatile, and multi-function, multi-option headwear. The outer liner 30 and the second liner 31 can be utilized with a transparent or opaque material allowing the person to view the objects or conceal them within. This provides a better functioning surface to adhere collector stickers, stamps or labels. The liners that form the pocket can be attached to the veil by the present securing devices or others in conjunction with other liners on the crown or brim for a differing purpose or utility.

The two liners forming the pocket can be placed any where on the crown 17 or the brim 18. The two liners forming the pocket can be secured with attachment units 33 (see FIG. 8) or other fastening devices. The liner forming the pocket can be placed in variable quantity on the headwear 16 therefore utilizing the headwear 16 with a multitude of removable pockets. The two liners forming the removable pocket can adopt different sizes or shapes thereby creating a more marketable liner. Pulling the two liners fastening units in opposing directions opens the pocket area allowing objects to be stored within. The pocket is not exclusive to the above mentioned and dependent upon the person, advertiser or manufacturer. The hook and loop fasteners or securing devices can be placed in reverse order thereby forming a different fastening method on the headwear 16.

FIG 5 is a bottom view of FIG. 2 indicating the layers of a permanent pocket headwear. A band 19 secured to a crown 17 through stitching 29 or other securing methods. A brim 18 attached to a crown 17 and the band 19 through stitching 29 or other suitable methods. The brim 18 embodiment can encompass the entire crown 17 or any part thereof. The individual liners are shown for a permanent pocket type design and the pocket opening is in its secured position, an exploded view detailing the individual elements are shown in FIG. 6.

The brim 18 can be of a substantially crescent shape, but can be of any shape and style. The brim 18 can be constructed of one or more plies of fabric such as cotton, wool, canvas, pack cloth, and designed to give the preferred amount of rigidity and durability. The brim 18 can be of varying lengths, sizes or shapes and utilized for protection to the person. The brim 18 provides shade to a persons face and front head area and protect against elements.

FIG. 6 is an exploded view of the back portion in FIG. 5 wherein a loop fastener 26 sewn or attached by other securing devices from one part of the brim encompassing the bottom outside portion of a crown 17 to the other part of the brim. A hook fastener 25 sewn or attached by other securing devices to the entire inside bottom portion of a outer liner 30. Thereby forming a seal between the crown 17 and the outer liner 30 and providing temporary securing for objects placed within a pocket area 32. A loop fastener 26 sewn or attached by other securing devices to the entire outside bottom portion of the outer liner 30. The hook fastener 25 sewn or attached by other securing devices to the entire top portion of a veil 21. The pocket can be opened and resealed many times by way of the closure devices.

Other types of seals can be used such as a snap, clasp, button or other items that can be opened and closed readily. The pocket opening can be expanded encompassing the entire headwear by enlarging the liners or any part thereof thereby allowing bulkier objects to fit within. Several openings can be made in the liners dependent upon the measure of the liners. The pocket area 32 is where various items can be located for safekeeping or when not in use.

Figure 7:
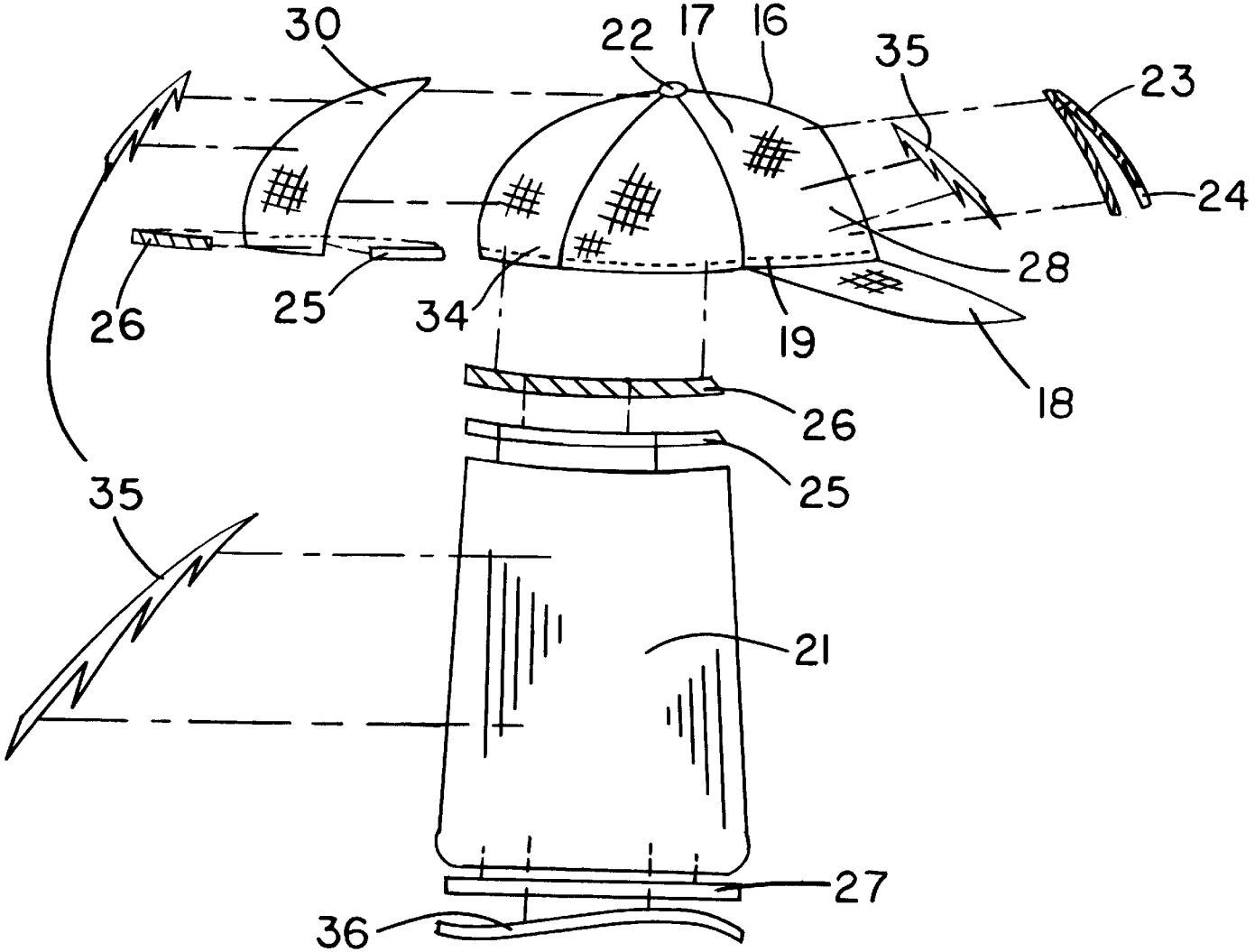
FIG. 7 discloses a side view of FIG. 1, FIG. 2, FIG. 5, and FIG. 6 disclosing all parts in separated fashion of the permanent pocket headwear.

FIG. 7 is a side view of FIG. 1 indicating a permanent pocket headwear unit with all parts of the headwear 16 separated. The headwear 16 has a brim 18 attached to a crown 17 with a button 22 and a band 19 as the integral parts of the basic headwear 16.

Attachments include a loop fastener 26 secured to the entire bottom outside of crown 34 exclusive of the brim 18 area. A hook fastener 25 secured to the entire inside bottom of an outer liner 30 and the side edges stitched or otherwise secured to the crown 17 as shown in FIG. 2 hence creating a pocket area 32 (see FIG. 6). The loop fastener 26 secured to the entire bottom outside portion of outer liner 30 in combination with the loop fastener 26 encompassing the crown join with the hook fastener 25 located on the top inside portion of the veil secures the veil to the headwear 16. An optional fastener 27 can be placed on veil 21 at variable locations to create a pocket or holding area on the veil 21 by attachment of fastener 27 to one or more additional fasteners (not shown) but similar to fastener 27. A handle device 36 can be attached to the veil 21 to form a combination veil and/or carrying entity. On a front portion 28 an outside grasping member 23 with a grasping end 24 opens to hold various items outside the headwear 16. Ornamentation 35 can be attached to the crown 17, brim 18, veil 21, or outer liner 30 giving it a more desirable appearance.

Figure 8:
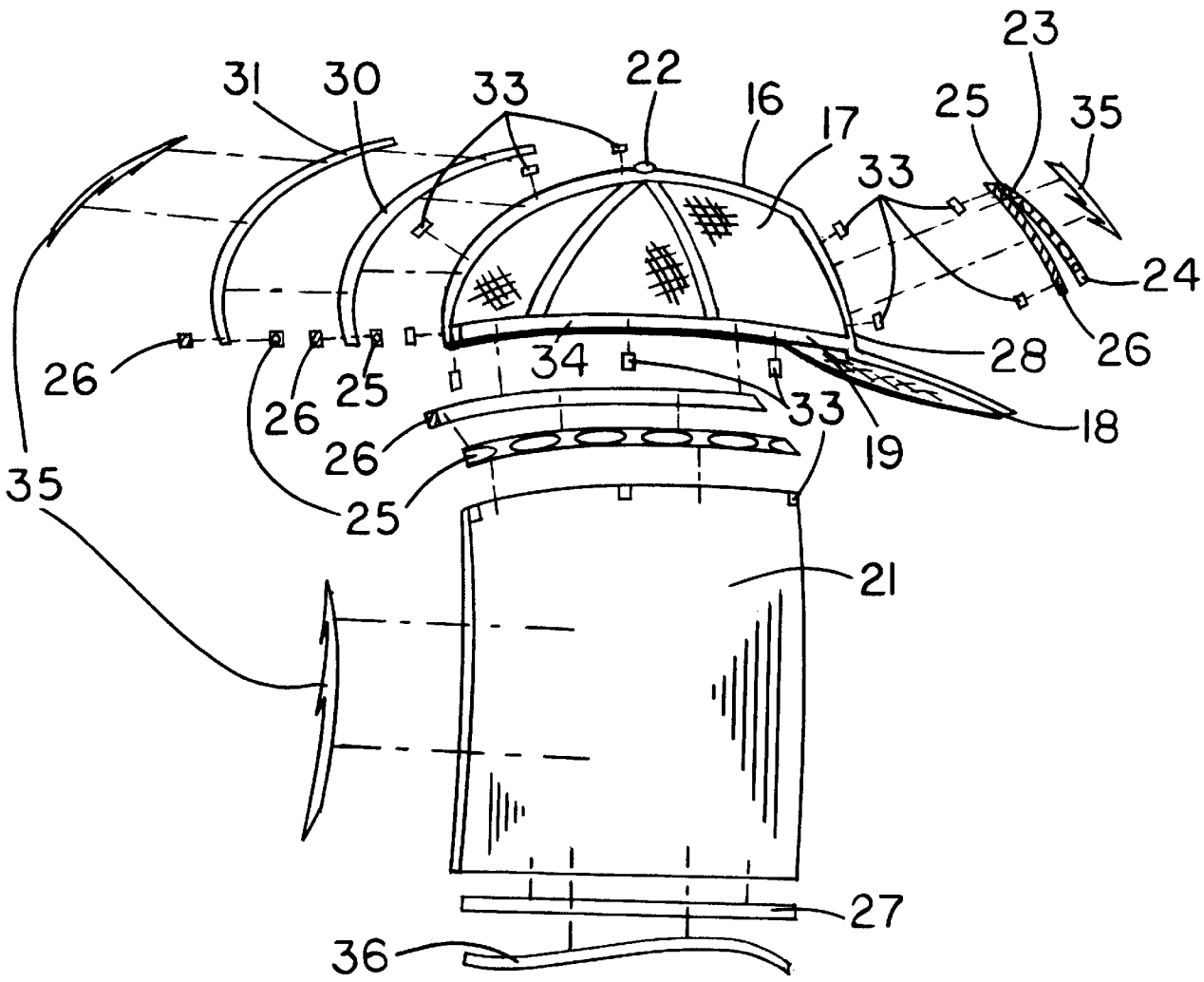
FIG. 8 discloses a longitudinal section of FIG. 3 and FIG. 4 disclosing all parts in separated fashion of the removable pocket headwear.

FIG. 8 is a side view of FIG. 1 showing a removable pocket headwear unit with all parts separated and the basic parts of a headwear 16 described in FIG. 7.

Attachments include a loop fastener 26 secured permanently or temporarily around the circumference of the bottom portion of crown 17, exclusive of a brim 18 area. The loop fastener 26 (see FIG. 3) attached from a button 22 downward to a bottom portion of crown 34 in the approximate angle of a outer liner 30, thereby forming an identical sealing counterpart. A hook fastener 25 secured inside the bottom portion of outer liner 30 edges that incorporates the same dimensions and length thereby forming an identical sealing counterpart on the crown 17.

The outer liner 30 and a second outer liner 31 two edges that meet at the button 22 are sewn or attached together by other securing devices. The loop fastener 26 secured outside the entire bottom edge portion of outer liner 30 forms one part of the pocket opening fastener. The hook fastener 25 secured inside the entire bottom edge portion of the second liner 31 and forms the second part of the pocket opening fastener. A pocket area 32 formed between the outer liner 30 and the second liner 31 is created enabling objects to be temporarily stored within. The loop fastener 26 secured to the entire bottom outside portion of the second liner 31 in combination with the loop fastener 26 encompassing the crown join with the hook fastener 25 located on the top inside portion of the veil secures the veil to the headwear 16. If the outer liner 30 and the second liner 31 are removed the veil 21 fastens to the remaining loop fastener 26 (see FIG. 2) which encircles the crown 17. An optional fastener 27 be placed on veil 21 at variable locations to create a pocket or holding area on the veil 21 by attachment of fastener 27 to one or more additional fasteners (not shown) but similar to fastener 27. A handle device 36 can be attached to the veil 21 to form a combination veil and/or carrying entity. An outside grasping member 23 with a grasping end 24 opens to hold various items on the outside of the headwear 16 and can be secured by an attachment unit 33 or other fastening devices.

The attachment unit 33 can secure to the bottom of crown 34 starting at one edge of the brim 18 and continuing to the other edge of the brim 18 spaced proportionately. The attachment unit 33 can secure proportionately to the top of the veil 21 thereby attaching to the units on the bottom of crown 34. The attachment unit 33 can secure to the front center portion of the crown 17 where a like but opposite attachment unit 33 can hold the grasping member 23 in place. Attachment units 33 can be located on the top of the crown 17 near the button 22 and along the edges proportionately to where the outer liner 30 would contact. The attachment units 33 can secure to the corners and in the middle of the outer 30 liner thereby holding it onto the back portion or anywhere the attachment units 33 are located on the crown 17. Ornamentation 35 can be attached to the veil 21, outer liner 30, brim 18, or crown 17 of the headwear 16 giving it a more desirable appearance.

Figure 9:
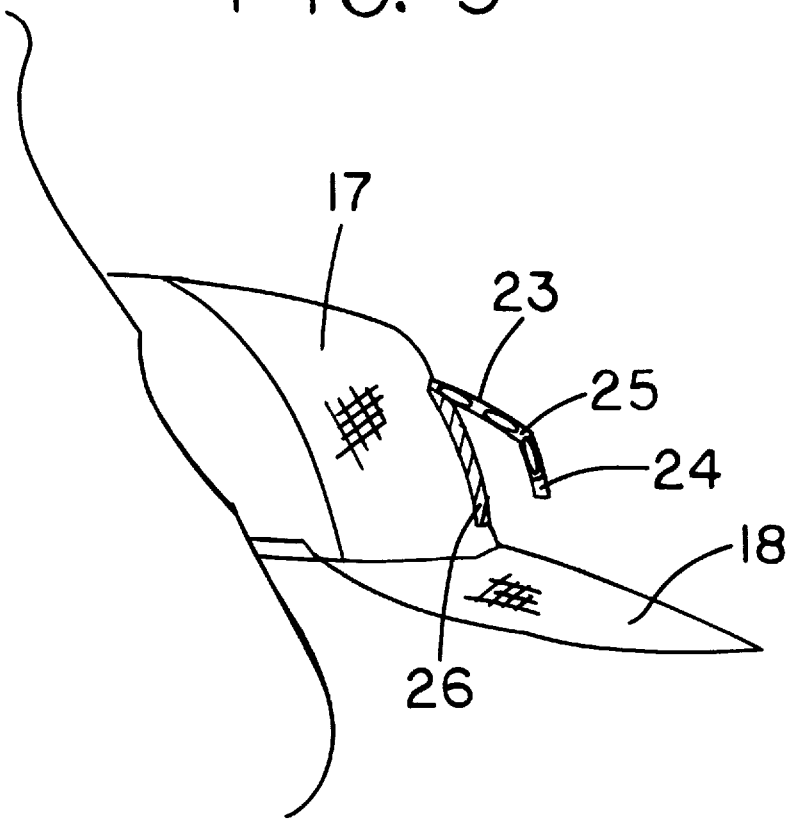
FIG. 9 discloses a partial side view of FIG. 1 disclosing the outside grasping member in the semi open position with the grasping end.

FIG. 9 is a partial side view of FIG. 1 showing a crown 17 and a brim 18. An outside grasping member 23 in the semi open position. The grasping member 23 made from a hook fastener 25 or other securing devices in proportionate length with a loop fastener 26 secure together at the upper end by stitching or other securing devices. The lower hook end folded slightly onto itself and sealed by stitching or other securing devices creates a grasping end 24 for easy opening. Other techniques can be utilized to form a grasping end 24 for easy opening and sealing. When both the hook and the loop fasteners are together they can equal the same length. Pulling up on the grasping end 24 separates the two fasteners and allows an object to be placed within. Returning the grasping end 24 to its original position seals the remaining fastener and locks the object in place.

An attachment unit can be placed on the upper and lower end of the loop fastener 26 for removal if a person so desires. The grasping member 23 can be opened to hold items such as eyeglasses, sunglasses, fish lures, sporting items, or other objects too large or bulky to fit inside the pocket. The grasping member 23 can be removed and placed within a pocket area 32 (see FIG. 6) when no longer desired. The grasping member 23 can be attached anywhere about the headwear. The hook like member or loop like member can be larger or smaller than its partner thereby allowing for larger objects to be held within the grasping member. The grasping member can be of variable shapes or sizes dependent upon the size or shape object the wearer, manufacturer, or advertiser require. The grasping member can be of variable color. The member can include a logo, insignia, inscription or other items.

Accordingly, the reader will see my headwear attachments provide a significant improvement over present inventions. My headwear provides easy access to store articles within and outside the headwear and provides protection against the elements. My headwear provides a potential storing and/or carrying entity utilizing the veil. My headwear provides a true novelty asset with its many varied uses not only as a traditional headwear but as a marketing, advertising, and collectors' device. No single headwear offers as much protection, interior storing ability, exterior storing ability, varied attachment locations, positions and variations with as many advantages, advertising potential, novelty, and promotional benefits as does my headwear.

Although the description above contains many details, these should not be construed as limiting the scope of the invention but as merely providing illustrations of some presently preferred embodiments of this invention. For example, the crown can have other shapes, such as triangular, oval, rectangular, etc.; the brim can have other shapes such as longer, wider, or encircling; the veil can have other shapes such as rectangular, triangular, square, the liner(s) which form the pocket can have other shapes, sizes, and in multitude and can be placed in multiple locations; the outside grasping member can have other lengths, sizes, shapes or be placed anywhere on the headwear.

Variations or modifications in this invention can occur to those skilled in the art upon reviewing the subject matter without departing from the scope of the invention. Such variations or modifications, if within the spirit of this invention, are intended to be encompassed within the scope of any claims to patent protection issuing hereon. It is intended that all matter contained in the above description or shown in the accompanying drawings shall be interpreted as illustrative and not in a limiting sense.

Headwear for protecting, holding, and collecting with or without removable receptacles.

What I claim is:

1. A headwear apparatus comprising:

a crown comprised of a plurality of triangular shaped panels of fabric connected together at a plurality of adjacent seams with a base of each of said plurality of triangular-shaped panels of fabric defining a band adapted to fit the head of a user, and a vertex opposite the base of each of said plurality of triangular-shaped panels being connected together at an upper portion of said crown;

a horizontal planar member connected to a lower portion of said crown defining a brim;

a triangular-shaped outer pocket liner connected to a rear portion of said crown opposite said brim and forming a pocket between said outer pocket liner and said crown, said triangular-shaped outer pocket liner connected to said crown along two sides extending from the upper portion of said crown to the band adapted to fit the head of a user, a pocket opening being defined between a base of said triangular-shaped outer pocket liner and a lower portion of said crown adjacent the band.

2. The headwear of claim 1 wherein, said pocket opening includes a closable fastener.

3. The headwear of claim 1 further including a vertical hanging section of fabric removably connectable to a lower rear portion of said crown defining a veil.

4. The headwear of claim 3 wherein, said veil includes at least two fasteners that are connectable together to form at least one pocket or holding area.

5. The headwear of claim 1 further including means, attached to said crown, for grasping and securing an accessory object to said crown.

6. A cap of the type having a crown sized to fit the head of a user, a brim, and a removable pocket, comprising:

first and second substantially triangular-shaped wall members each having a perimeter including two sides and a base, said first and second wall members disposed adjacent each other and connected together at a portion of each of said perimeters along the sides defining the pocket, a portion of each of said perimeters along the bases not connected together defining a pocket opening;

at least one of said first and said second substantially triangular-shaped wall members removably connected to a rear exterior portion of the crown, a vertex of each of said triangular-shaped wall members disposed at an upper portion of the crown, said pocket opening disposed along a lower edge of the crown.

7. The cap and removable pocket of claim 6 wherein, said pocket opening includes a closable fastener.

8. The cap and removable pocket of claim 6 further including a vertical hanging section of fabric removably connectable to a lower portion of the crown defining a veil.

9. The cap and removable pocket of claim 8 wherein said veil further includes at least two fasteners that are connectable together to form at least one pocket or holding area.

10. The cap and removable pocket of claim 6 further including means, attached to the crown, for grasping and securing an accessory object to the crown.

* * * * *